US009297232B2

(12) United States Patent
Scott et al.

(10) Patent No.: US 9,297,232 B2
(45) **Date of Patent: *Mar. 29, 2016**

(54) RECLOSABLE MULTI ZONE ISOLATION TOOL AND METHOD FOR USE THEREOF

(71) Applicant: Halliburton Energy Services, Inc., Houston, TX (US)

(72) Inventors: Keith Wayne Scott, Lavon, TX (US); William David Henderson, Tioga, TX (US); Douglas Allen Schafer, Euless, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 218 days.

This patent is subject to a terminal disclaimer.

(21) Appl. No.: 13/972,998

(22) Filed: Aug. 22, 2013

(65) Prior Publication Data

US 2014/0020912 A1 Jan. 23, 2014

Related U.S. Application Data

(63) Continuation of application No. 13/878,599, filed as application No. PCT/US2012/047125 on Jul. 18, 2012, now Pat. No. 8,757,275.

(51) Int. Cl.

| | |
|---|---|
| ***E21B 33/12*** | (2006.01) |
| ***E21B 34/00*** | (2006.01) |
| ***E21B 34/10*** | (2006.01) |
| ***E21B 33/127*** | (2006.01) |

(52) U.S. Cl.

CPC ..... *E21B 34/10* (2013.01); *E21B 33/127* (2013.01); *E21B 34/102* (2013.01)

(58) Field of Classification Search

CPC ..... E21B 33/127; E21B 34/10; E21B 34/12; E21B 34/14; E21B 34/102; E21B 34/105

USPC ..... 166/381, 387, 332.1, 321, 187

See application file for complete search history.

(56) References Cited

U.S. PATENT DOCUMENTS

| | | | | |
|---|---|---|---|---|
| 6,494,256 | B1 | 12/2002 | Achee, Jr. et al. | |
| 6,634,429 | B2 * | 10/2003 | Henderson et al. | 166/332.1 |
| 6,722,440 | B2 * | 4/2004 | Turner et al. | 166/374 |
| 6,997,263 | B2 * | 2/2006 | Campbell et al. | 166/374 |
| 7,306,033 | B2 | 12/2007 | Gorrara | |
| 7,343,983 | B2 | 3/2008 | Livingstone | |
| 2003/0019634 | A1 | 1/2003 | Henderson | |
| 2004/0020652 | A1 | 2/2004 | Campbell et al. | |

OTHER PUBLICATIONS

International Search Report and Written Opinion, KIPO, PCT/2012/047125, Mar. 28, 2013.

* cited by examiner

*Primary Examiner* — Kenneth L Thompson
*Assistant Examiner* — Michael Wills, III

(57) ABSTRACT

An apparatus for isolating a first zone from a second zone in a subterranean wellbore. The apparatus includes an outer tubular and an inner tubular disposed within the outer tubular forming an annular flow path therebetween that is in fluid communication with the first zone. The inner tubular defines a central flow path that is in fluid communication with the second zone. A sleeve having at least one seal is positioned in the annular flow path and is axially movable relative to the inner and outer tubulars between a closed position wherein the seal engages the inner tubular and an open position wherein the seal engages the outer tubular. A mandrel is slidably disposed within the inner tubular and is coupled to the sleeve. The mandrel is operable to shift the sleeve between the open position and the closed position responsive to changes in pressure within the central flow path.

17 Claims, 7 Drawing Sheets

RECLOSABLE MULTI ZONE ISOLATION TOOL AND METHOD FOR USE THEREOF

CROSS-REFERENCE TO RELATED APPLICATIONS

The present application is a continuation of co-pending application Ser. No. 13/878,599, filed Apr. 10, 2013, which is a United States National Stage application of International Application no. PCT/US2012/047125, filed Jul. 18, 2012. The entire disclosures of these prior applications are incorporated herein by this reference.

TECHNICAL FIELD OF THE INVENTION

This invention relates, in general, to equipment utilized in conjunction with operations performed in subterranean wells and, in particular, to a reclosable multi zone isolation tool for isolating an upper zone from a lower zone in a subterranean wellbore and a method for use thereof

BACKGROUND OF THE INVENTION

Without limiting the scope of the present invention, its background will be described with reference to producing multiple hydrocarbon bearing subterranean zones in a well, as an example. It is common to encounter hydrocarbon wells that traverse more than one separate subterranean hydrocarbon bearing zone. In such wells, the separate subterranean hydrocarbon bearing zones may have similar or different characteristics. For example, the separate subterranean hydrocarbon bearing zones may have significantly different formation pressures. Even with the different pressures regimes, it may nonetheless be desirable to complete each of the multiple zones prior to producing the well. In such cases, it may be desirable to isolate certain of the zones from other zones after completion.

For example, when multiple productive zones that have significantly different formation pressures are completed in a single well, hydrocarbons from a high pressure zone may migrate to a lower pressure zone during production. It has been found, however, that this migration of hydrocarbons from one zone to another may decrease the ultimate recovery from the well. One way to overcome this fluid loss from a high pressure zone into a lower pressure zone during production and to maximize the ultimate recovery from the well is to initially produce only the high pressure zone and delay production from the lower pressure zone. Once the formation pressure of the high pressure zone has decreased to that of the lower pressure zone, the two zones can be produced together without any loss of reserves. It has been found, however, that from an economic perspective, delaying production from the lower pressure zone while only producing from the high pressure zone may be undesirable.

A need has therefore arisen for an apparatus that provides for the isolation of separate zones traversed by a wellbore. A need has also arisen for such an apparatus that does not required delayed production from a lower pressure zone during production from a high pressure zone. Further, a need has arisen for such an apparatus that does not allow fluid loss from a high pressure zone into a lower pressure zone if both zones are produced at the same time.

SUMMARY OF THE INVENTION

The present invention disclosed herein comprises an apparatus and method that provides for the isolation of separate zones traversed by a wellbore. In addition, the apparatus and method of the present invention do not required delayed production from a lower pressure zone during production from a high pressure zone. Further, the apparatus and method of the present invention enable simultaneous production from multiple zones without fluid loss from a high pressure zone into a lower pressure zone.

In one aspect, the present invention is directed to an apparatus for isolating a first zone from a second zone in a subterranean wellbore. The apparatus includes an outer tubular and an inner tubular disposed within the outer tubular forming a substantially annular flow path therebetween that is in fluid communication with the first zone. The inner tubular defines a central flow path therein that is in fluid communication with the second zone. A sleeve having at least one seal disposed on an inner surface thereof is positioned in the annular flow path to control fluid flow therethrough. The sleeve is axially movable relative to the outer tubular and the inner tubular between a closed position wherein the seal engages an outer surface of the inner tubular and an open position wherein the seal engages an outer surface of the outer tubular. A mandrel is slidably disposed within the inner tubular and coupled to the sleeve. The mandrel is operable to shift the sleeve between the open position and the closed position responsive to changes in pressure within the central flow path.

In one embodiment, a collet assembly is coupled to the sleeve to selectively prevent shifting of the sleeve relative to the outer tubular when the sleeve is in the open position and when the sleeve is in the closed position. In another embodiment, the sleeve has a plurality of seals disposed on the inner surface thereof such that the seals engage the outer surface of the inner tubular in the closed position and the outer surface of the outer tubular in the open position. In some embodiments, the outer tubular includes an extension that forms a substantially annular pocket such that the at least one seal engages the outer surface of the extension in the open position.

In certain embodiments, the mandrel forms at least a portion of the inner tubular. In one embodiment, the mandrel and the inner tubular define an actuation chamber operable to receive pressure from within the central flow path to bias the mandrel in a first direction relative to the inner tubular and shift the sleeve from the closed position to the open position. In another embodiment, an equalization pathway is disposed within the annular flow path to selectively prevent operation of the sleeve from the closed position to the open position.

In some embodiments, a lock assembly is positioned between the mandrel and the inner tubular that selectively prevents movement of the mandrel in the second direction relative to the inner tubular when the sleeve is in the open position. In these embodiments, the lock assembly may include a spring operated lug support and at least one lug such that the lug support props the lug radially outwardly to create interference with the inner tubular. Also, in these embodiments, the mandrel may include at least one reclosing port operable to receive pressure from within the central flow path, when the sleeve is in the open position, to release the lock assembly and to bias the mandrel in the second direction relative to the inner tubular, thereby shifting the sleeve from the open position to the closed position.

In another aspect, the present invention is directed to an apparatus for isolating a first zone from a second zone in a subterranean wellbore. The apparatus includes an outer tubular and an inner tubular disposed within the outer tubular forming a substantially annular flow path therebetween that is in fluid communication with the first zone. The inner tubular defines a central flow path therein that is in fluid communication with the second zone. The outer tubular includes an extension that forms a substantially annular pocket. A sleeve having at least one seal disposed on an inner surface thereof is positioned in the annular flow path to control fluid flow therethrough. The sleeve is axially movable relative to the outer tubular and the inner tubular between a closed position wherein the seal engages an outer surface of the inner tubular and an open position wherein the seal engages an outer surface of the extension of the outer tubular. A mandrel is slidably disposed within the inner tubular and is coupled to the sleeve. The mandrel is operable to shift the sleeve between the open position and the closed position responsive to changes in pressure within the central flow path. The mandrel and the inner tubular define an actuation chamber operable to receive pressure from within the central flow path to bias the mandrel in a first direction relative to the inner tubular and shift the sleeve from the closed position to the open position. The mandrel includes at least one reclosing port operable to receive pressure from within the central flow path when the sleeve is in the open position to bias the mandrel in a second direction relative to the inner tubular and shift the sleeve from the open position to the closed position.

In a further aspect, the present invention is directed to a method for isolating a first zone from a second zone in a subterranean wellbore. The method includes disposing a multi zone isolation tool within the wellbore in a closed position, the tool including an inner tubular defining a central flow path and an outer tubular defining an annular flow path with the inner tubular, the annular flow path in fluid communication with the first zone, the central flow path in fluid communication with the second zone; maintaining the tool in the closed position while treating the second zone by equalizing pressure in the central flow path and the annular flow path; operably coupling a tubing string with the inner tubular; varying the pressure in the central flow path; biasing a mandrel slidably disposed within the inner tubular in a first direction; shifting a sleeve having at least one seal disposed on an inner surface thereof and coupled to the mandrel from the closed position wherein the seal engages an outer surface of the inner tubular to an open position wherein the seal engages an outer surface of the outer tubular; aligning a fluid diverter with at least one reclosing port of the mandrel; varying the pressure in the central flow path; biasing the mandrel in a second direction; and shifting the sleeve from the open position to the closed position.

The method may also include selectively preventing shifting of the sleeve when the sleeve is in the open position and when the sleeve is in the closed position with a collet assembly coupled to the sleeve, selectively preventing movement of the mandrel in the second direction when the sleeve is in the open position with a lock assembly positioned between the mandrel and the inner tubular, propping the lug radially outwardly with a spring operated lug support to create interference with the inner tubular, releasing the lock assembly and/or pressurizing an actuation chamber disposed between the mandrel and the inner tubular.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

The present invention provides improved methods and tools for completing and separately producing individual hydrocarbon zones in a single well. The methods can be performed in either vertical or horizontal wellbores. The term "vertical wellbore" is used herein to mean the portion of a wellbore in a producing zone, which is substantially vertical, inclined or deviated. The term "horizontal wellbore" is used herein to mean the portion of a wellbore in a producing zone, which is substantially horizontal. Since the present invention is applicable in vertical, horizontal and inclined wellbores, the terms "upper and lower" and "top and bottom" as used herein are relative terms and are intended to apply to the respective positions within a particular wellbore while the term "levels" is meant to refer to respective spaced positions along the wellbore. The term "zone" is used herein to refer to separate parts of the well designated for treatment and/or production and includes an entire hydrocarbon formation or separate portions of the same formation. As used herein, "down," "downward" or "downhole" refer to the direction in or along the wellbore from the wellhead toward the producing zone regardless of the wellbore's orientation toward the surface or away from the surface. Accordingly, the upper zone would be the first zone encountered by the wellbore and the lower zone would be located further along the wellbore. Tubing, tubular, casing, pipe liner and conduit are interchangeable terms used herein to refer to walled fluid conductors.

Figure 1:
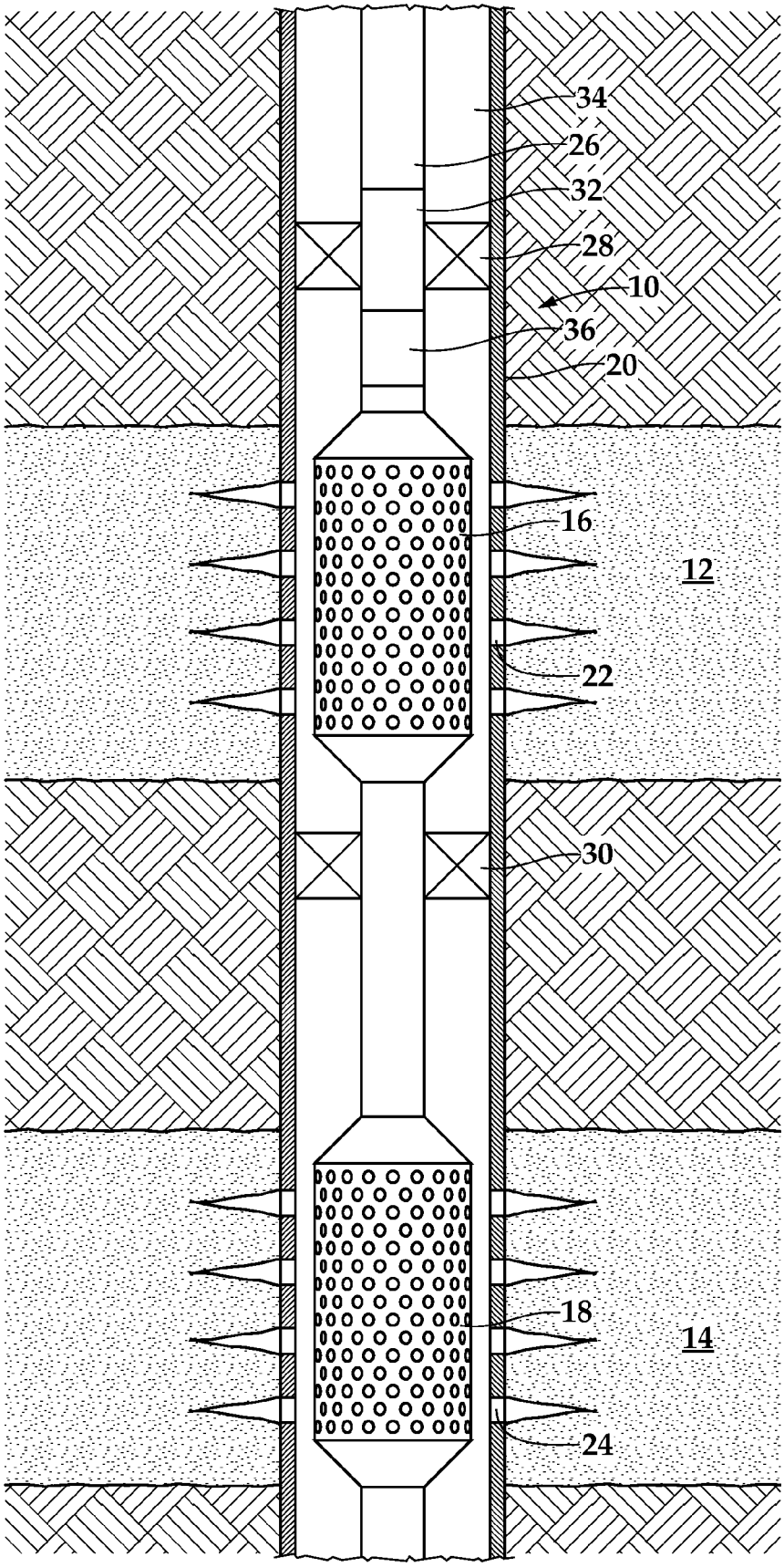
FIG. 1 is a schematic illustration of a completion system including a multi zone isolation tool of the present invention.

Referring initially to FIG. 1, a multi zone isolation tool of the present invention is disposed within a cased wellbore that is generally designated 10. Wellbore 10 is illustrated intersecting two separate hydrocarbon bearing zones, upper zone 12 and lower zone 14. For purposes of description, only two zones are shown but it is understood that the present invention has application to isolate any number of zones within a well. As mentioned, while wellbore 10 is illustrated as a vertical cased well with two producing zones, the present invention is applicable to horizontal and inclined wellbores with more than two producing zones and in uncased wells.

A completion string disposed within wellbore 10 includes upper and lower sand screen assemblies 16, 18 that are located proximate to zones 12, 14, respectively. Wellbore 10 includes a casing string 20 that has been perforated at locations 22, 24 to provide fluid flow paths into casing 20 from zones 12, 14, respectively. The completion string includes production tubing 26, packers 28, 30 and a crossover sub 32 to enable fluid flow between the interior of the completion string and annulus 34. The completion string also includes multi zone isolation tool 36 of the present invention. As explained in greater detail below, tool 36 functions to connect lower sand screen assembly 18 and production tubing 26 via a first flow path. Tool 36 also functions to selectively isolate and connect upper sand screen assembly 16 to annulus 34 via a second flow path. Thus, tool 36 selectively isolates zone 12 and zone 14 and allows zones 12, 14 to be independently produced.

Referring next to FIGS. 2A-2D, therein is depicted a more detailed illustration of an embodiment of a multi zone isolation tool of the present invention that is generally designated 100. Tool 100 includes a substantially tubular outer housing assembly 102 that is formed from a plurality of housing members that are securably and sealingly coupled together by threading, set screws or similar technique. In the illustrated embodiment, housing assembly 102 includes an upper housing member 104, a first upper intermediate housing member 106, a second upper intermediate housing member 108 having a housing extension 110, a housing coupling 112, a sleeve housing member 114 that forms a substantially annular pocket 116 with housing extension 110, a lower intermediate housing member 118, a housing coupling 120 and a lower housing member 122. It is to be understood by those skilled in the art that even though a particular arrangement of housing members is depicted and described, other arrangements of housing members are possible and are considered within the scope of the present invention.

Disposed within housing assembly 102 is an inner tubular assembly 124 that is formed from a plurality of tubular members that are securably and sealingly coupled together by threading, set screws or similar technique. In the illustrated embodiment, tubular assembly 124 includes an upper tubular member 126 having a polished bore receptacle 128, a first upper intermediate tubular member 130 having a radially expanded region 132, a second upper intermediate tubular member 134 having a lower shoulder 136, a first intermediate tubular member 138, a second intermediate tubular member 140, a first lower intermediate tubular member 142 having a profile 144, a second lower intermediate tubular member 146 and a lower tubular member 148. It is to be understood by those skilled in the art that even though a particular arrangement of tubular members is depicted and described, other arrangements of tubular members are possible and are considered within the scope of the present invention.

Slidably disposed within tubular assembly 124 is a mandrel assembly 150 that is formed from a plurality of mandrel members that are securably and sealingly coupled together by threading, set screws or similar technique. In the illustrated embodiment, mandrel assembly 150 includes an upper mandrel member 152 including a profile 154 and a plurality of reclosing ports 156, an intermediate mandrel member 158 that carries one or more lugs 160 and a lower mandrel member 162 including a plurality of opening ports 164. It is to be understood by those skilled in the art that even though a particular arrangement of mandrel members is depicted and described, other arrangements of mandrel members are possible and are considered within the scope of the present invention.

Disposed between tubular assembly 124 and mandrel assembly 150 is a lug support sleeve 166 and a spring 168. Together, lug support sleeve 166, spring 168 and lugs 160 may be referred to as a lock assembly. Near their lower ends, tubular assembly 124 and mandrel assembly 150 define an actuation chamber 170 that is in fluid communication with opening ports 164 of mandrel assembly 150. Together, tubular assembly 124 and mandrel assembly 150 define a central flow path 172 that extends between the upper and lower ends of tool 100. As such, at least portions of mandrel assembly 150 may be considered as part of tubular assembly 124 in the section between tubular member 130 and tubular member 134. As previously described with reference to FIG. 1, central flow path 172 is in fluid communication with lower sand screen assembly 18 and therefore lower zone 14.

Together, housing assembly 102 and tubular assembly 124 define a substantially annular flow path 174. As previously described with reference to FIG. 1, annular flow path 174 is in fluid communication with upper sand screen assembly 16 and therefore upper zone 12. Disposed within annular flow path 174 is a sleeve 176 that has a plurality of seals 178 disposed on the inner surface thereof. In the illustrated embodiment, sleeve 176 is threadably coupled to a collet assembly 180. Near its lower end, sleeve 176 is securably coupled to mandrel assembly 150 via a threaded connector held in position by a pin 182 that extends through one of three radially expanded sections of mandrel assembly 150 (only one being visible in the figures). Each of the radially expanded sections extends approximately thirty degrees in the circumferential direction such that the flow of fluid through annular flow path 174 is not prevented by the radially expanded sections. Also disposed within annular flow path 174 is an equalization pathway depicted as control line 184 that extends between tubular member 130 and tubular member 146.

The operation of tool 100 will now be described with reference to FIGS. 2A-2D and 3A-3D. Tool 100 is initially run into the wellbore as part of the completion string with housing assembly 102 preferably forming a portion of the tubular string that extends to the surface. The completion string is the positioned at the desired location, such as that depicted in FIG. 1. Initially, tool 100 is in its closed position as depicted in FIGS. 2A-2D wherein sleeve 176 is in its lower position with seals 178 engaging an outer sealing surface of tubular member 130 such that fluid flow through annular flow path 174 is prevented. In this configuration, treatment or other operations requiring fluid flow and pressure fluctuations downhole of tool 100 are performed through central flow path 172. Even though pressure fluctuations are occurring in central flow path 172 and are communicated to actuation chamber 170 and therefore to a lower piston area of mandrel assembly 150, operation of tool 100 is prevented. Specifically, annular flow path 174 and central flow path 172 are in fluid communication with one another above tool 100. In addition, the pressure in annular flow path 174 above sleeve 176 is communicated to an upper piston area of mandrel assembly 150 via control line 184 that serves as a pathway to equalize pressure across mandrel assembly 150.

Figure 2A:
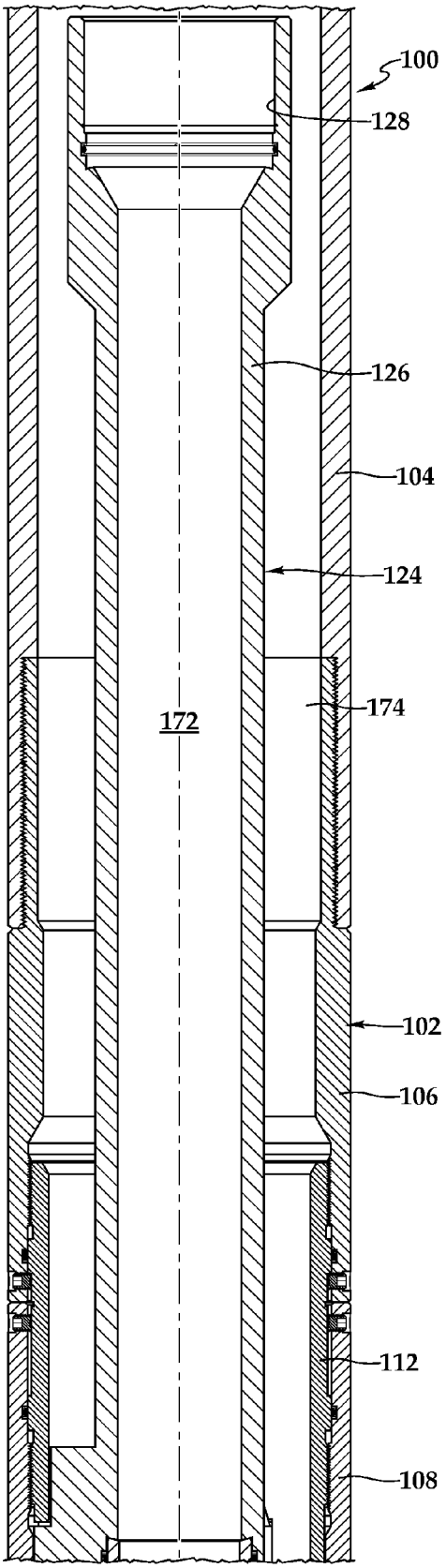
FIGS. 2A-2D are cross sectional views of successive axial sections of a multi zone isolation tool of the present invention in the closed position.
Figure 2B:
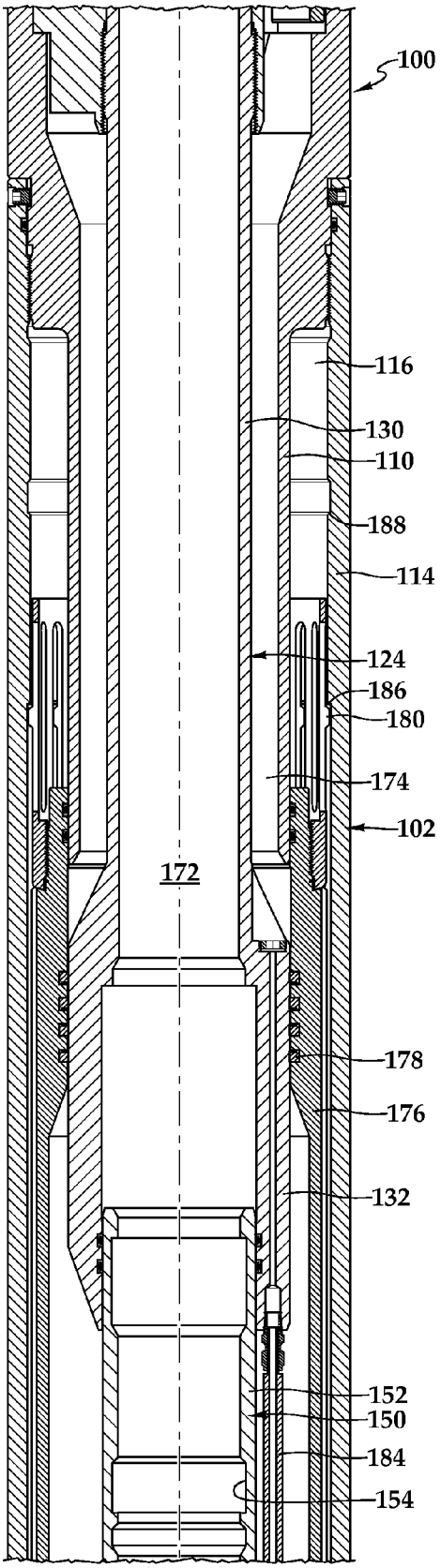
Figure 2C:
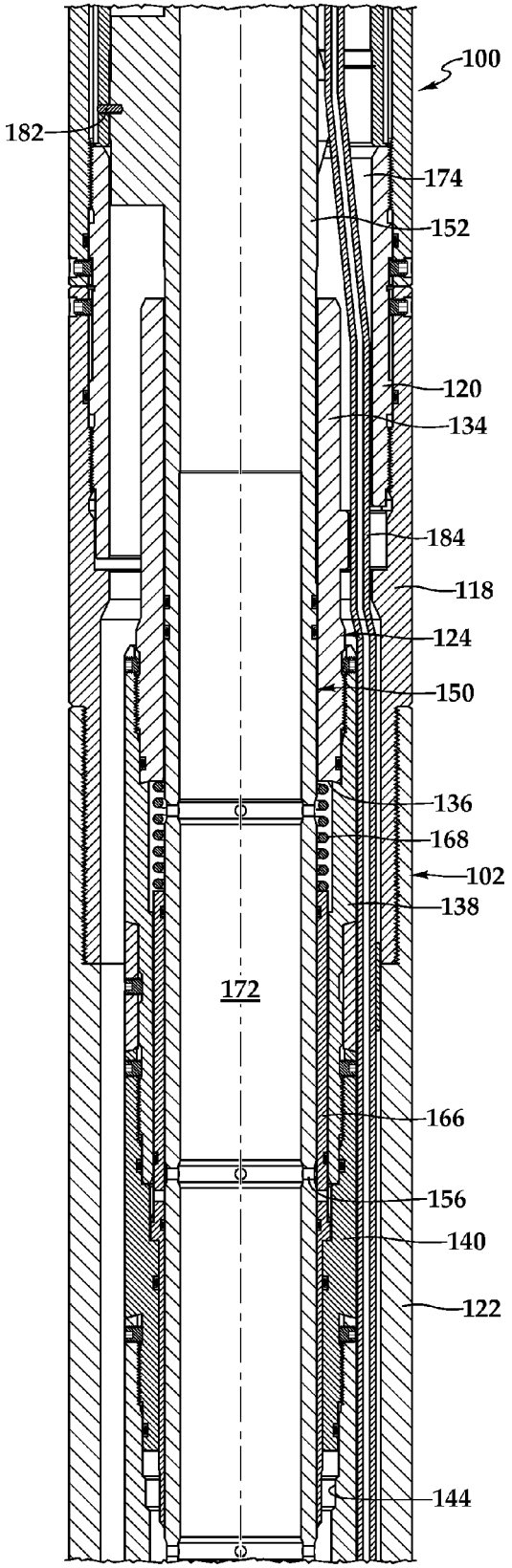
Figure 2D:
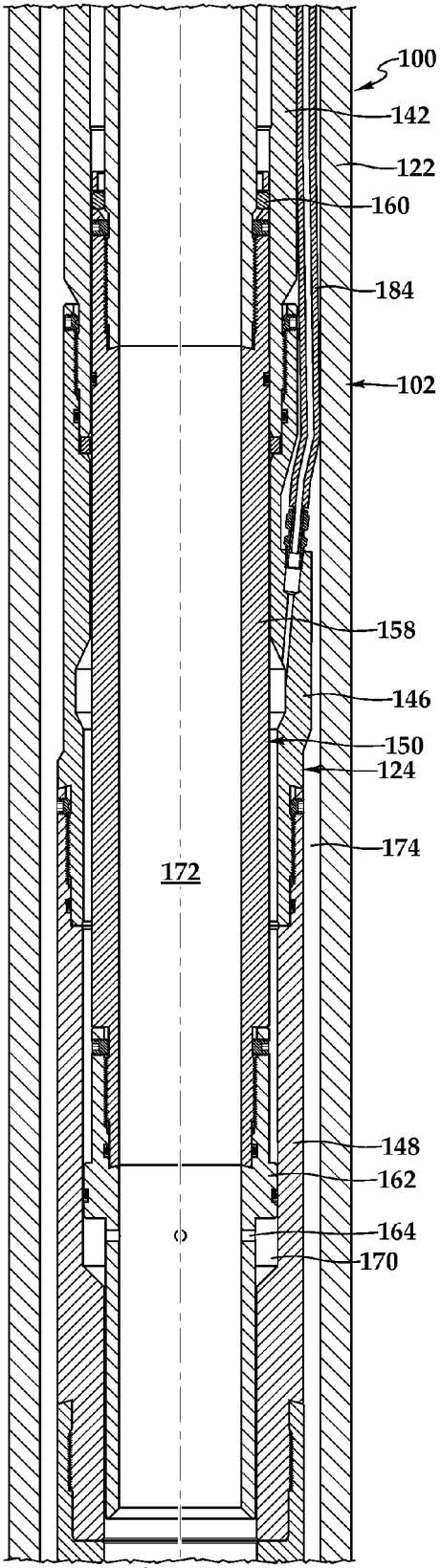

After treatment or other operations to the lower zone or zones are complete, the lower zones may be plugged off and a tubing string may be stabbed into polished bore receptacle 128 of tubular assembly 124. In this configuration, annular flow path 174 and central flow path 172 are no longer in fluid communication with one another above tool 100. Now, increased pressure within central flow path 172 is communicated to actuation chamber 170 via opening ports 164. This pressure acts on the lower piston area of mandrel assembly 150 and urges mandrel assembly in the uphole direction. Mandrel assembly 150 is threadably coupled to sleeve 176 and sleeve 176 is threadably coupled to collet assembly 180. As best seen in FIG. 2B, collet assembly 180 selectively prevents upward movement of sleeve 176 and mandrel assembly 150 until the pressure exerted on the lower piston area of mandrel assembly 150 exceeds a predetermined value sufficient to radially inwardly retract the collet fingers of collet assembly 180, to pass through a downwardly facing shoulder 186 of housing assembly 102.

Figure 3A:
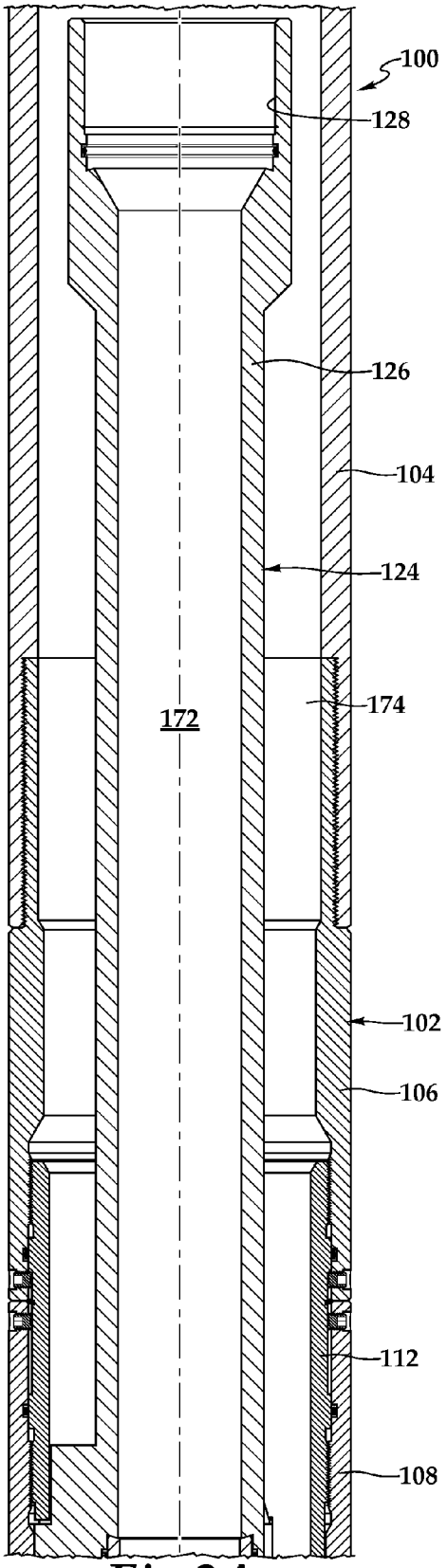
FIGS. 3A-3D are cross sectional views of successive axial sections of a multi zone isolation tool of the present invention in the open position.
Figure 3B:
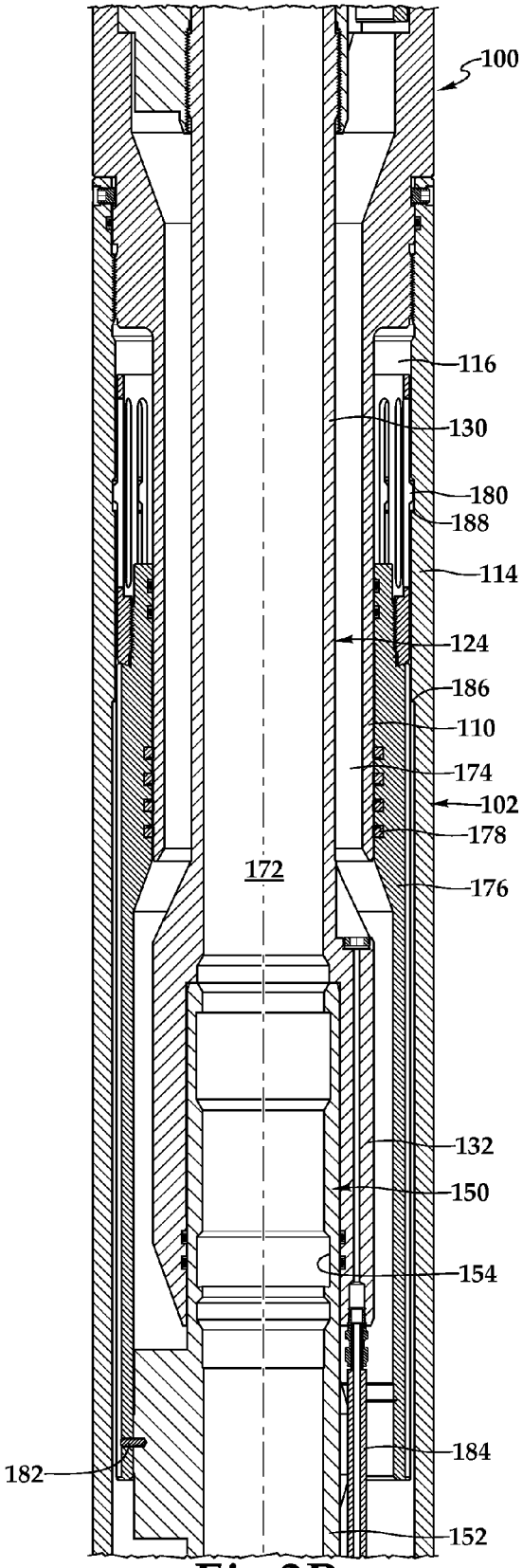
Figure 3C:
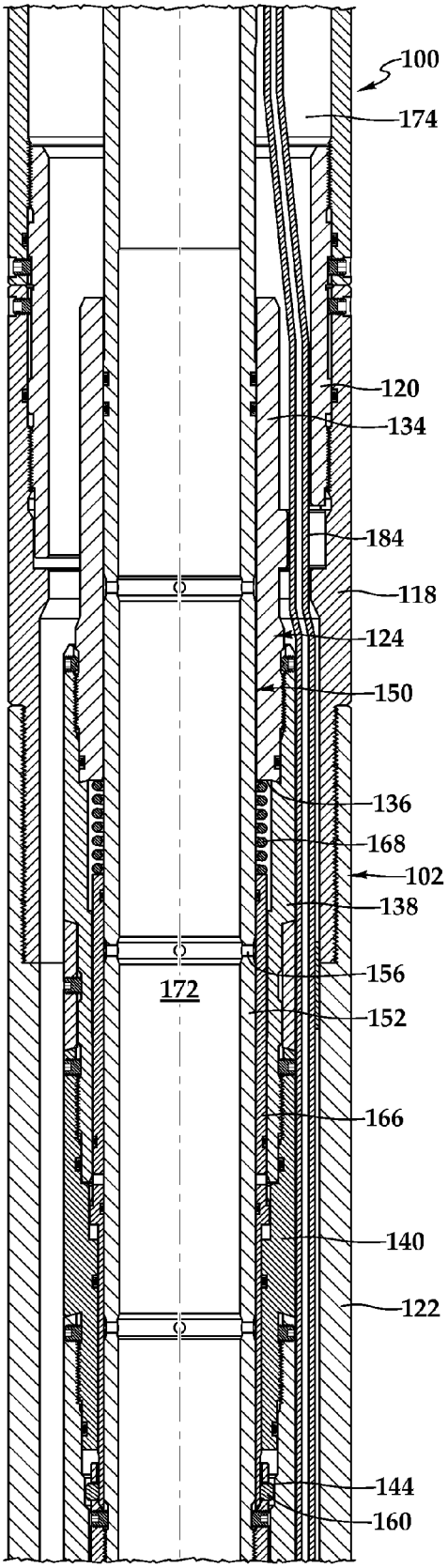
Figure 3D:
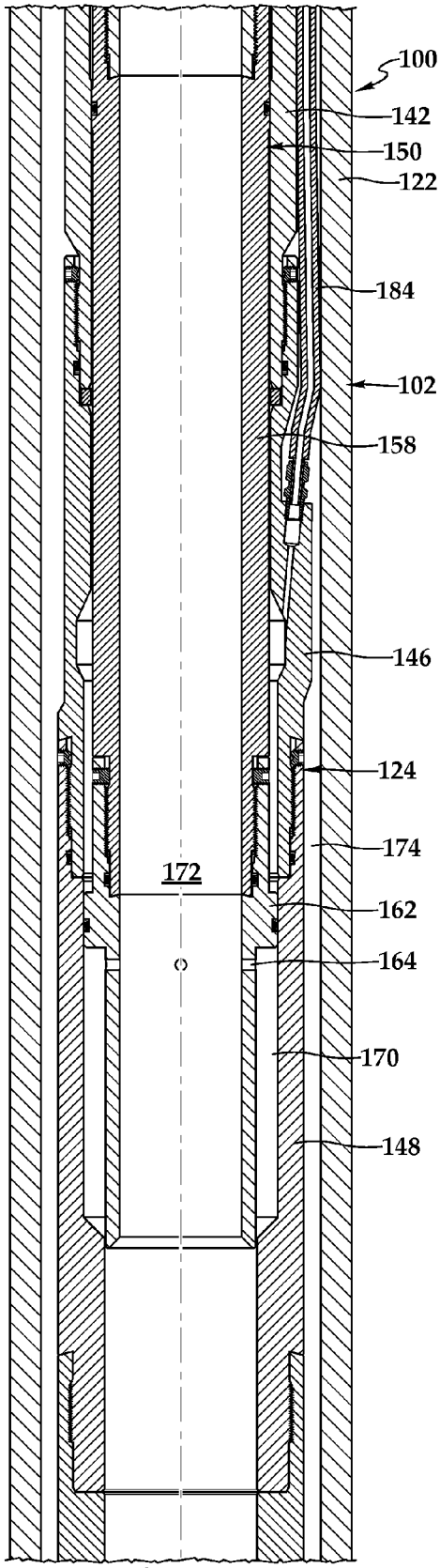

When the predetermined value is reached and the collet fingers of collet assembly 180 are radially retracted, sleeve 176 and mandrel 150 shift in the uphole direction to the position depicted in FIGS. 3A-3D. As illustrated, collet assembly 180 reengages with housing assembly 102 in annular recess 188. Sleeve 176 is in its upper position partially disposed within annular pocket 116 of housing assembly 102 with seals 178 engaging an outer sealing surface of housing extension 110. In this configuration, fluid communication between annular flow path 174 and the upper zone is allowed, enabling, for example, production from the upper zone into annular flow path 174. Importantly, in this configuration, seals 178 are protected from fluid flow or any abrasive materials therein as seals 178 are sealingly engaged with the outer sealing surface of housing extension 110 and out of the flow path. As such, seals 178 are not susceptible to damage during production from the upper zone or other fluid flow operations therethrough. Also, in this configuration, downhole movement of mandrel assembly 150 is prevented as spring 168 has urged lug support sleeve 166 under lugs 160 which are now aligned with and interfere with profile 144 of tubular member 142, as best seen in FIG. 3C.

Figure 4A:
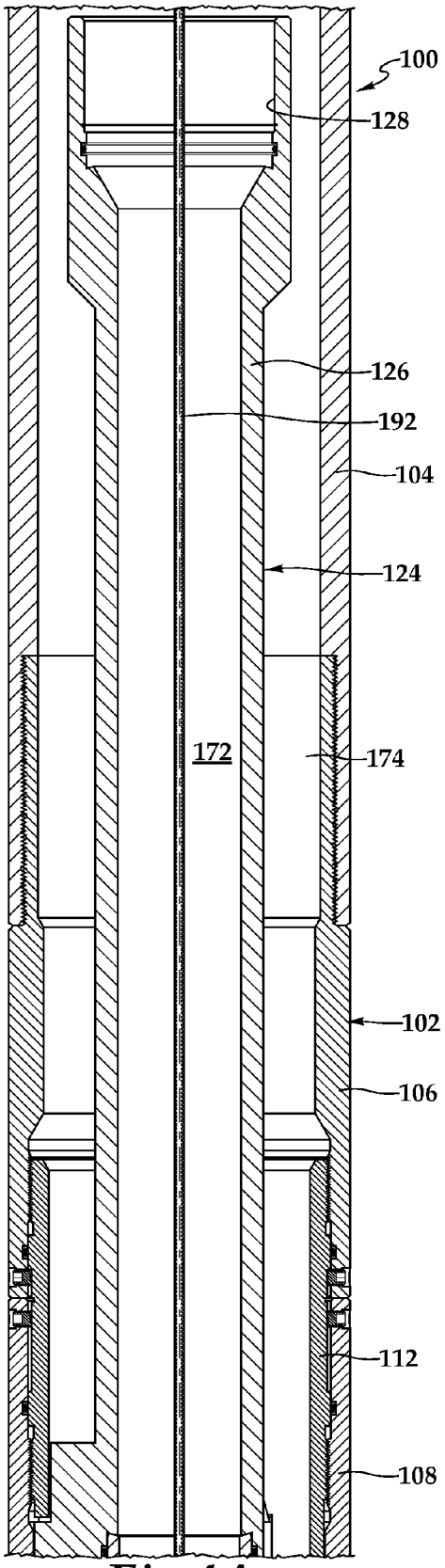
FIGS. 4A-4D are cross sectional views of successive axial sections of a multi zone isolation tool of the present invention in the open position with a fluid diverter positioned therein.
Figure 4B:
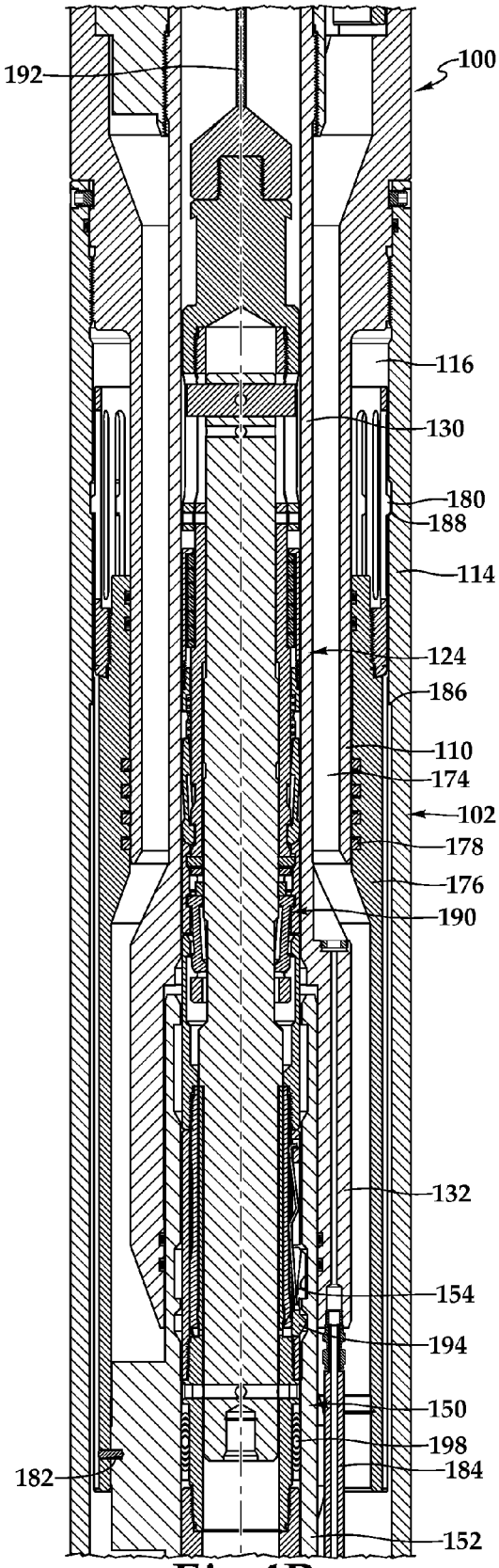
Figure 4C:
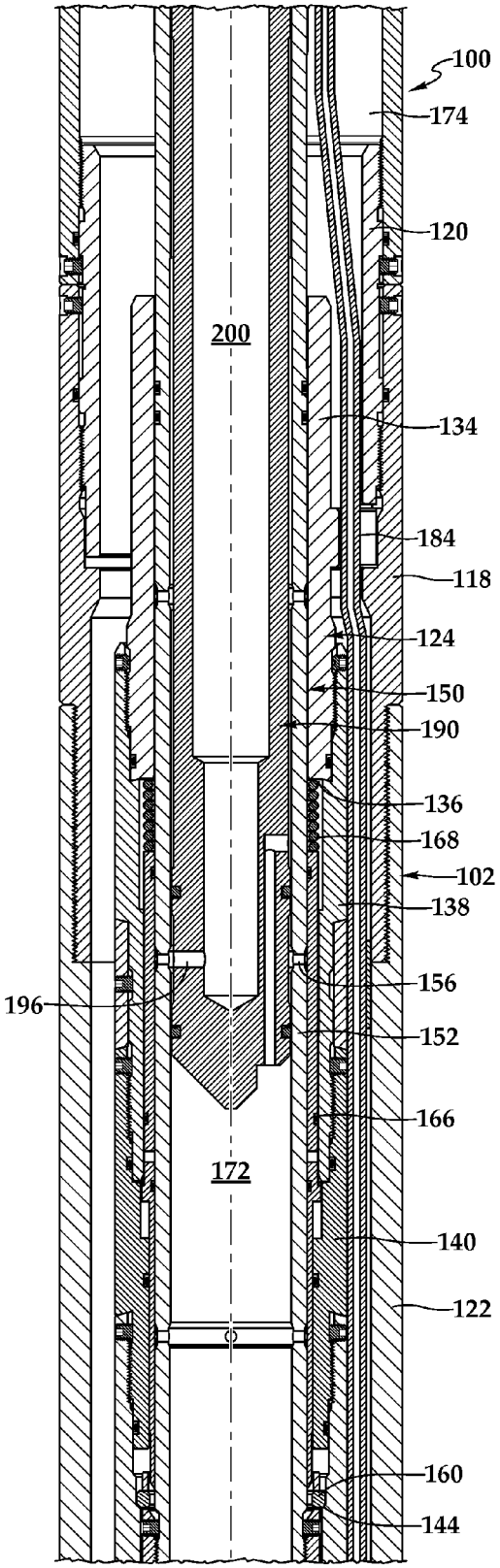
Figure 4D:
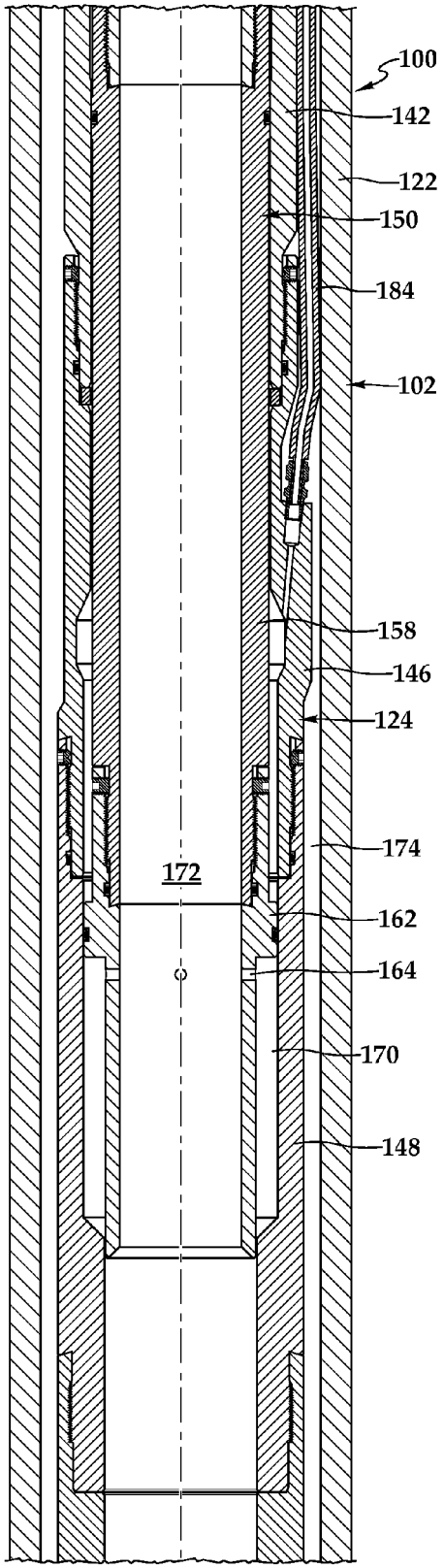

Referring additionally to FIGS. 4A-4D, if it is desired to return tool 100 from the open position to the closed position, a fluid diverter 190 may be run downhole on a conveyance that is depicted as wireline 192 and positioned within tool 100. Fluid diverter 190 includes a latch assembly 194 that is operable to engage profile 154 of mandrel assembly 150. Once engaged, a discharge port 196 of fluid diverter 190 is in fluid communication with reclosing ports 156 of mandrel assembly 150. In this configuration, fluid pressure above seals 198 of fluid diverter 190 in central flow path 172 is routed to chamber 200, which is in fluid communication with reclosing ports 156 via discharge port 196. The fluid pressure then acts on a lower piston area of lug support sleeve 166 which compresses spring 168 and unprops lugs 160, as best seen in FIG. 4C.

The fluid pressure from chamber 200 now acts on an upper piston area of mandrel assembly 150 and urges mandrel assembly 150 downhole. As best seen in FIG. 4B, collet assembly 180 selectively prevents downward movement of sleeve 176 and mandrel assembly 150 until the pressure exerted on the upper piston area of mandrel assembly 150 exceeds a predetermined value sufficient to radially inwardly retract the collet fingers of collet assembly 180, to pass through an upwardly facing shoulder of annular recess 188 of housing assembly 102. When the predetermined value is reached and the collet fingers of collet assembly 180 are radially retracted, sleeve 176 and mandrel 150 shift in the downhole direction to the position depicted in FIGS. 2A-2D. As illustrated, collet assembly 180 is now repositioned below downwardly facing shoulder 186 of housing assembly 102, thereby selectively preventing upward movement of sleeve 176 and mandrel assembly 150. Sleeve 176 is now repositioned in its lower position with seals 178 engaging an outer sealing surface of tubular member 130. In this configuration, fluid flow through annular flow path 174 is prevented and tool 100 has been returned to its closed configuration. The processes of opening and reclosing tool 100 can be repeated as required to enable independent and selective production from the upper and lower zones.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. An apparatus for isolating a first zone from a second zone in a subterranean wellbore, the apparatus comprising:

an outer tubular and an inner tubular disposed within the outer tubular forming a substantially annular flow path therebetween that is in fluid communication with the first zone, the inner tubular defining a central flow path therein that is in fluid communication with the second zone;

a sleeve having at least one seal disposed on an inner surface thereof, the sleeve positioned in the annular flow path to control fluid flow therethrough, the sleeve axially movable relative to the outer tubular and the inner tubular between a closed position wherein the seal engages an outer surface of the inner tubular and an open position wherein the seal engages an outer surface of the outer tubular; and a mandrel slidably disposed within the inner tubular and coupled to the sleeve, the mandrel operable to shift the sleeve between the open position and the closed position responsive to changes in pressure within the central flow path.

2. The apparatus as recited in claim 1 further comprising a collet assembly coupled to the sleeve, the collet assembly selectively preventing shifting of the sleeve relative to the outer tubular when the sleeve is in the open position and when the sleeve is in the closed position.

3. The apparatus as recited in claim 1 wherein the sleeve has a plurality of seals disposed on the inner surface thereof, the seals engaging the outer surface of the inner tubular in the closed position and the outer surface of the outer tubular in the open position.

4. The apparatus as recited in claim 1 wherein the outer tubular includes an extension that forms a substantially annular pocket, the extension forming the outer surface of the outer tubular that engages the at least one seal in the open position.

5. The apparatus as recited in claim 1 wherein the mandrel forms at least a portion of the inner tubular.

6. The apparatus as recited in claim 1 wherein the mandrel and the inner tubular define an actuation chamber operable to receive pressure from within the central flow path to bias the mandrel in a first direction relative to the inner tubular and shift the sleeve from the closed position to the open position.

7. The apparatus as recited in claim 6 further comprising a lock assembly positioned between the mandrel and the inner tubular, the lock assembly operable to selectively prevent movement of the mandrel in a second direction relative to the inner tubular when the sleeve is in the open position.

8. The apparatus as recited in claim 7 wherein the lock assembly further comprises a spring operated lug support and at least one lug, the lug support propping the lug radially outwardly to create interference with the inner tubular.

9. The apparatus as recited in claim 7 wherein the mandrel includes at least one reclosing port operable to receive pressure from within the central flow path when the sleeve is in the open position to release the lock assembly, bias the mandrel in the second direction relative to the inner tubular and shift the sleeve from the open position to the closed position.

10. The apparatus as recited in claim 1 further comprising an equalization pathway disposed within the annular flow path to selectively prevent operation of the sleeve from the closed position to the open position.

11. A method for isolating a first zone from a second zone in a subterranean wellbore, the method comprising:

disposing a multi zone isolation tool within the wellbore in a closed position, the tool including an inner tubular defining a central flow path and an outer tubular defining an annular flow path with the inner tubular, the annular flow path in fluid communication with the first zone, the central flow path in fluid communication with the second zone;

maintaining the tool in the closed position while treating the second zone by equalizing pressure in the central flow path and the annular flow path;

operably coupling a tubing string with the inner tubular;

varying the pressure in the central flow path;

biasing a mandrel slidably disposed within the inner tubular in a first direction; and shifting a sleeve having at least one seal disposed on an inner surface thereof and coupled to the mandrel from the closed position wherein the seal engages an outer surface of the inner tubular to an open position wherein the seal engages an outer surface of the outer tubular.

12. The method as recited in claim 11 further comprising selectively preventing shifting of the sleeve when the sleeve is in the open position and when the sleeve is in the closed position with a collet assembly coupled to the sleeve.

13. The method as recited in claim 11 further comprising selectively preventing movement of the mandrel in the second direction when the sleeve is in the open position with a lock assembly positioned between the mandrel and the inner tubular.

14. The method as recited in claim 13 wherein selectively preventing movement of the mandrel in the second direction when the sleeve is in the open position further comprises propping a lug radially outwardly with a spring operated lug support to create interference with the inner tubular.

15. The method as recited in claim 13 further comprising:

aligning a fluid diverter with at least one reclosing port of the mandrel;

varying the pressure in the central flow path; and releasing the lock assembly.

16. The method as recited in claim 15 further comprising biasing the mandrel in a second direction and shifting the sleeve from the open position to the closed position.

17. The method as recited in claim 11 wherein biasing the mandrel slidably disposed within the inner tubular in the first direction further comprises pressurizing an actuation chamber disposed between the mandrel and the inner tubular.

* * * * *